United States Patent [19]

Ichinose

[11] Patent Number: 4,530,336

[45] Date of Patent: Jul. 23, 1985

[54] INJECTION TIMING CONTROL DEVICE FOR INTERNAL COMBUSTION ENGINE

[75] Inventor: Toshio Ichinose, Sayama, Japan

[73] Assignee: Diesel Kiki Company, Ltd., Tokyo, Japan

[21] Appl. No.: 542,823

[22] Filed: Oct. 17, 1983

[30] Foreign Application Priority Data

Oct. 29, 1982 [JP] Japan ..... 57-163952[U]

[51] Int. Cl.[3] ..... F02M 59/20; F02M 59/32

[52] U.S. Cl. ..... 123/502; 123/501; 464/2

[58] Field of Search ..... 123/502, 501, 500; 464/2, 5

[56] References Cited

U.S. PATENT DOCUMENTS 4,304,205 12/1981 Bauer ..... 464/2
4,332,227 6/1982 Bauer ..... 123/502

FOREIGN PATENT DOCUMENTS 46-40055 11/1971 Japan ..... 123/502
0157023 9/1982 Japan ..... 123/502

*Primary Examiner*—Carl Stuart Miller
*Attorney, Agent, or Firm*—David G. Alexander

[57] ABSTRACT

An injection timing control device for an internal combustion engine includes a connector plate constantly biased in a predetermined direction. A hydraulic actuator urges the connector plate in the other direction in response to a fluid pressure communicated thereto, thereby actuating an eccentric cam mechanism to vary a fuel injection timing. The line of action of the biasing force and that of the urging force opposite to the biasing force, each imparted to the connector plate, lie in a common plane which contains an axis of the hydraulic actuator, so that the connector plate is prevented from tilting and thereby effecting the operation of the cam mechanism.

2 Claims, 5 Drawing Figures

INJECTION TIMING CONTROL DEVICE FOR INTERNAL COMBUSTION ENGINE

BACKGROUND OF THE INVENTION

The present invention relates to an injection timing control device for an internal combustion engine and, more particularly, to an improvement in a hydraulically operated injection timing control device.

A prior art injection timing control device of the type described includes a disc and a cam support plate which is mounted on a shaft and connected to the disc by an eccentric cam mechanism. One of the disc and shaft is connected to a shaft of a fuel injection pump, and the other to a crankshaft of an engine. A hydraulic actuator surrounds the shaft associated with the cam support and includes cylinders. A pair of generally U-shaped connector plates are arranged one above the other between the cylinders and the cam support straddling the shaft and are movable relative to each other. Opposite ends of each connector plates are bent perpendicular to the general plane of the plate to form a pair of tongues. A guide rod extends throughout the adjacent tongues of the two connector plates. A return spring is loaded between each end of the guide rod and one of the tongues which faces the rod end. The connector plates are individually connected by pins to the eccentric cam mechanism mounted in the cam support and to pistons installed in the hydraulic actuator.

The problem encountered with the prior art injection timing controller described above is that cams included in each eccentric cam mechanism are apt to become locked in position to prevent the injection timing from being adjusted smoothly and stably. The inherent construction allows a moment to act in one direction on each connector plate, tending to cause the connector plate to tilt. This tendency is increased by clearances defined at both sides of the connector plate. When the connector plate is tilted, the eccentric cam mechanism associated therewith is also tilted allowing slidable members of the mechanism to catch each other. Another problem brought about by such a tendency of the connector plates is that the eccentric cam mechanisms are locally worn out to limit the durability of the whole device.

The present invention constitutes an improvement over the prior art hydraulically operated injection timing control device described above.

SUMMARY OF THE INVENTION

It is therefore an object of the present invention to provide an injection timing control device of the type described which achieves excellent reliability of operation.

It is another object of the present invention to provide an injection timing control device of the type described which withstands a long time of operation.

It is another object of the present invention to provide a generally improved injection timing control device of the type described.

A hydraulically operated injection timing control device for an internal combustion engine of the present invention includes a first member connected to one of the engine and a fuel injection pump associated with the engine, and a second member including a shaft connected to the other. A cam assembly operatively connects the first and second members to each other, while a hydraulic actuates the cam assembly. Connector means operatively connects the hydraulic actuator to the cam assembly. The hydraulic actuator controllably urges the connector means on and along a first line of action in response to a hydraulic fluid pressure communicated thereto. Returning means returns the connector means on and along a second line of action which is parallel to and opposite in direction to the first line of action. The first and second lines of action commonly lie in a plane which is perpendicular to an axis of the shaft of the second member and contains an axis of the hydraulic actuator therein.

In accordance with the present invention, an injection timing control device for an internal combustion engine includes a connector plate constantly biased in a predetermined direction. A hydraulic actuator urges the connector plate in the other direction in response to a fluid pressure communicated thereto, thereby actuating an eccentric cam mechanism to vary a fuel injection timing. The line of action of the biasing force and that of the urging force opposite to the biasing force each imparted to the connector plate lie in a common plane which contains an axis of the hydraulic actuator, so that the connector plate is prevented from tilting and thereby effecting the operation of the eccentric cam assembly.

The above and other objects, features and advantages of the present invention will become apparent from the following detailed description taken with the accompanying drawings.

DESCRIPTION OF THE PREFERRED EMBODIMENT

While the injection timing control device for an internal combustion engine of the present invention is susceptible of numerous physical embodiments, depending upon the environment and requirements of use, a substantial number of the herein shown and described embodiment have been made, tested and used, and all have performed in an eminently satisfactory manner.

Figure 1:
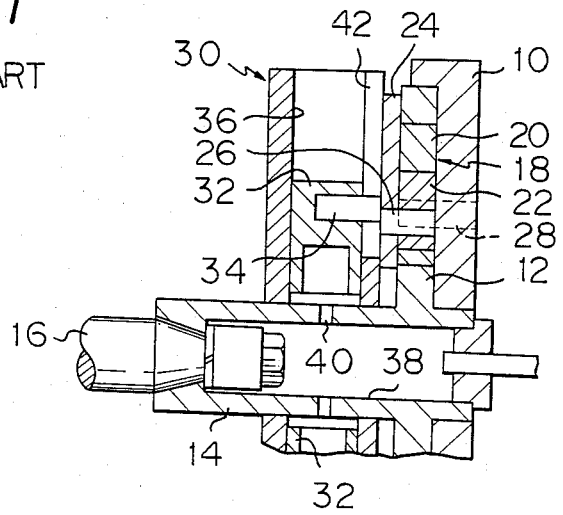
Fig. 1 PRIOR ART
FIG. 1 is a sectional side elevation of a prior art hydraulically operated injection timing control device.
Figure 2:
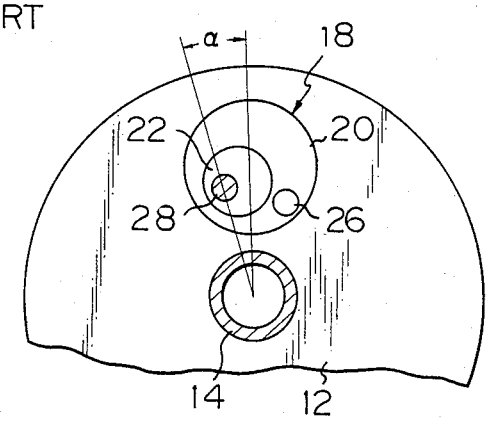
Fig. 2 PRIOR ART
FIG. 2 is a front view of an eccentric cam mechanism included in the device shown in FIG. 1.
Figure 3:
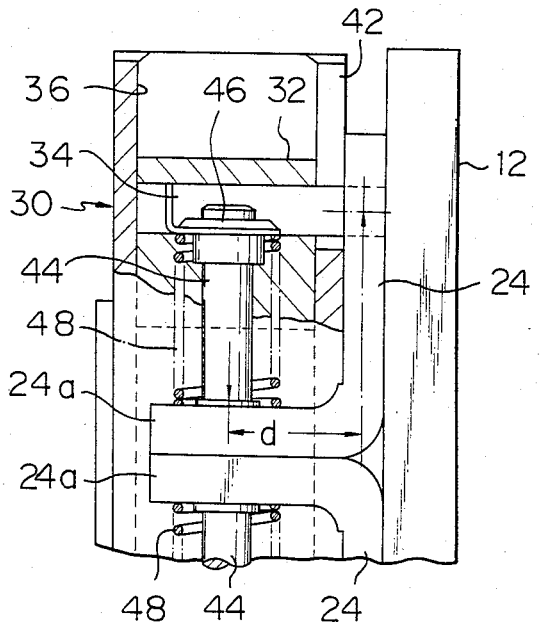
Fig. 3 PRIOR ART
FIG. 3 is a fragmentary view of connector plates and their neighborhood also included in the device of FIG. 1.

Before entering into detailed discussion of the present invention, a reference will be made to an example of prior art injection timing control devices of the type concerned, illustrated in FIGS. 1–3. The device includes a disc 10 and a cam support plate 12 one of which is connected to an internal combustion engine and the other to a fuel injection pump associated with the engine. In this particular embodiment, the disc 10 is connected to the crankshaft of an internal combustion engine, while the cam support plate 12 is formed integrally with a shaft 14 which is connected to a shaft 16 of a fuel injection pump. The disc 10 and cam support 12 are juxtaposed and rotatable relative to each other in a concentric position. Generally designated by the reference numeral 18 is an eccentric cam mechanism which is adapted to operatively connect the disc 10 and cam support 12 to each other as will be described.

A pair of such eccentric cam mechanism 18 (one is shown) are mounted in the cam support 12 in symmetrical position with respect to the shaft 14. As best shown in FIG. 2, the cam mechanism 18 comprises a first eccentric cam 20 movably received in a circular bore which is formed in the cam support 12. A second eccentric cam 22 is received in a circular bore which is formed in an offset position of the first eccentric cam 20. The first cam 20 is connected to a connector plate 24 by a pin 26, and the second cam 22 to the disc 10 by a pin 28.

A hydraulic actuator, generally 30, includes a piston 32 which is connected to the connector plate 24 by a pin 34. In detail, the hydraulic actuator 30 comprises a pair of cylindrical bores 36 formed side by side in a cylinder block which surrounds the shaft 14. Pistons 32 are respectively slidably received in the cylindrical bores 36 while holding the shaft 14 therebetween. The shaft 14 is formed with an axial bore 38 and radial passageways 40 which individually communicate the bore 38 to chambers between the shaft 14 and the pistons 32. A controlled amount of liquid is fed under pressure from the bore 38 to each of those chambers via a passageway 40, thereby shifting the associated piston 32 to actuate the eccentric cam mechanism 16 through the pin 34, connector plate 24, and pin 26. In conformity to the symmetrical arrangement of two cam mechanisms 18, a pair of such connector plates 24 are located one above the other between the cylinders 36 and the cam support 12 in such a manner as to be movable relative to each other diametrically of the shaft 14. The pin 34 connects the piston 32 to the connector plate 24 while passing through a slot 42 formed throughout the wall of the cylinder 36.

The connector plates 24 individually have identical, generally U-shaped configurations each straddling the shaft 14 from the above or below. As shown in FIG. 3, each connector plate 24 is bent at opposite ends of "U" substantially perpendicular to the general plane thereof so as to form a pair of tongues 24*a*. A guide rod 44 extends throughout the adjacent tongues 24*a* of the upper and lower connector plates 24 and carries spring retainers 46 at opposite ends thereof. Each of the tongues 24*a* cooperate with the adjacent spring retainer 46 to anchor a return spring 48 therebetween.

When fluid is fed under pressure into each cylinder 36, a piston 32 associated with the cylinder 36 is moved away from the shaft 14 to in turn move the pin 26 so that the first cam 20 is rotated within the cam support 12 to change the position of the second cam 22. That is, in FIG. 2, the line connecting the axis of the shaft 14 to the center of the first cam 20 and the line connecting it to the center of the pin 28, which is connected to the disc 10, define an angle therebetween which is variable in response to a movement of the pin 28 to adjust the fuel injection timing.

As described above, the prior art injection timing controller employs return springs 48 for returning the pistons 32 against the fluid pressure communicated to the hydraulic actuator 30. As shown in FIG. 3, each return spring 48 is coupled over a guide rod 44 which extends throughout the substantially perpendicular extension 24*a* at an end of the adjacent connector plate 24. One end of the return spring 48 is retained by the substantially perpendicular connector tongue 24*a*, and the other end by the spring seat 46 rigid on the guide rod 44. Meanwhile, the pin 34 extending parallel to the shaft 14 from the connector plate 24 is connected to the piston 32 through the slot 42 in the cylinder 36. In such an arrangement, the line of action of the force imparted by the return spring 48 to the connector plate 24 is spaced a distance d from the line of action of the force imparted by the pressure operated piston 32 to the connector plate 24. The distance d develops a moment acting on the connector plate 24. The upper connector plate 24, for example, receives a counterclockwise moment as viewed in FIG. 3 and this tendency to the counterclockwise movement is enhanced by a clearance usually left at each side of the connector 24. Once the connector plate 24 is inclined, the eccentric cam mechanism 18 is also inclined to allow the slidable members to catch each other, disenabling the injection timing to be adjusted smoothly.

The present invention is successful to eliminate the drawback encountered with the prior art injection timing control device as discussed above.

Figure 4:
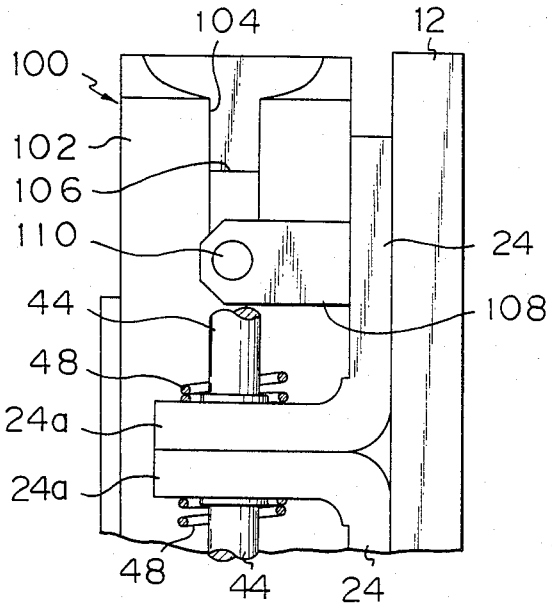
FIG. 4 is a fragmentary side elevation of a hydraulically operated injection timing control device embodying the present invention.
Figure 5:
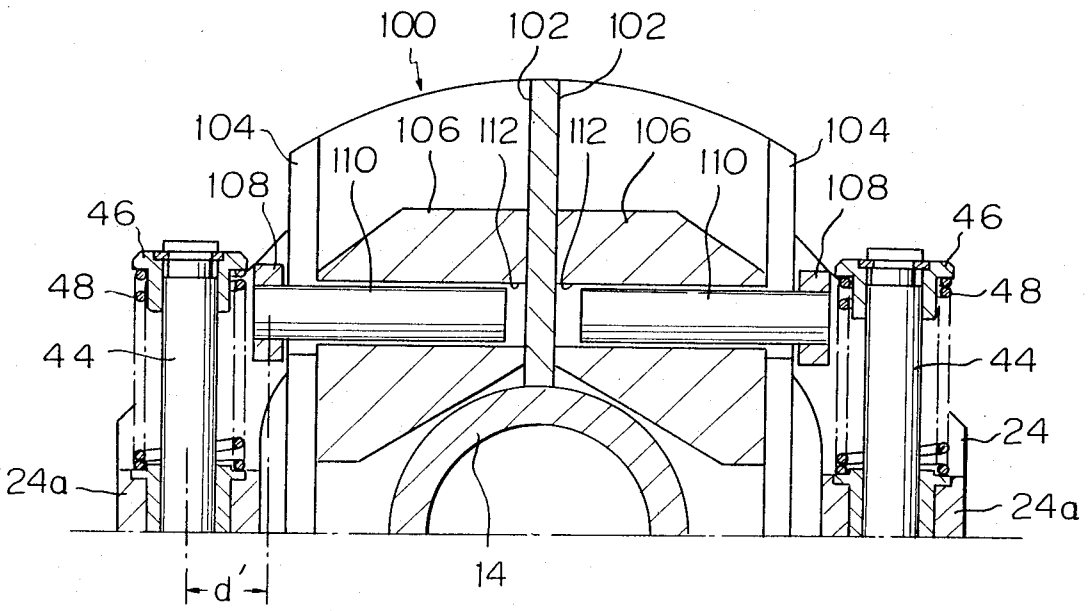
FIG. 5 is a sectional front view of the device shown in FIG. 4.

Referring to FIGS. 4 and 5, an injection timing control device embodying the present invention is shown. In these drawings, the same or similar structural elements as those shown in FIGS. 1–3 are designated by the same reference numerals for convenience. A cam support plate 12 has a cam mechanism mounted therein as described in conjunction with the prior art device, although not shown in FIG. 4 or 5. Opposite ends of each connector plate 24 are bent perpendicular to the general plane of the plate 24 to form a pair of tongues 24*a*. A guide rod 44 extends throughout the adjacent tongues 24*a* of the upper and lower connector plates 24. A return spring 48 is coupled over the guide rod 44 and retained between the tongue 24*a* and a spring seat 46.

A hydraulic actuator, generally 100, comprises a cylindrical bore 102 formed with a slot 104 which is open laterally outwardly toward the adjacent guide rod 44. A piston 106 is slidably received in the cylinder 102.

A bracket 108 extends from a laterally outer portion of the connector plate 24 perpendicularly to the general plane of the plate. The free end of the bracket 108 spans the slot 104 formed through the wall of the cylinder 102. A pin 110 is retained at one end by the free end of the bracket 108 to extend transversely throughout the slot 104 into the cylinder 102. The end of the pin 110 inside the cylinder 102 is received in a transverse bore 112 formed in the piston 106. As shown in FIG. 5, a pair of such bracket and pin assemblies are associated with each of the connector plate 24 so that their pins 110 extend inwardly toward each other.

As shown in FIG. 4, the guide rods 44 are positioned in a plane which contains the axes of the adjacent cylinders 102. It follows that the axis of each pin 110 transverses the axes of the adjacent guide rod 44 and piston 106 perpendicularly thereto.

In operation, a fluid under pressure acts on each of the pistons 106 by way of the route desribed in conjunction with the prior art device. The resulting force is imparted by each pin 110 to the associated bracket 108, which is rigid on the connector plate 24. Meanwhile, the force of the associated return spring 48 acts on the tongue 24*a* of the connector plate 24. The lines of action of these two forces lie in a common plane which contains the axes of the cylinders 102 and, additionally, the distance between the lines of action is quite short as indicated by d' in FIG. 5. This, compared to the prior art, significantly reduces the moment acting on the connector plate 24 due to the hydraulic pressure force and the force of each return spring, and this moment lies in the plane which is parallel to the general plane of the connector plate 24. As a consequence, the connector plate 24 is prevented from tilting relative to the eccentric cam mechanism 18 (FIGS. 1 and 2).

In summary, it will be seen that the present invention provides an injection timing control device for an internal combustion engine which is operable with stability and reliability while eliminating local wear to increase durability.

Various modifications will become possible for those skilled in the art after receiving the teachings of the present disclosure without departing from the scope thereof.

What is claimed is:

1. A hydraulically operated injection timing control device for an internal combustion engine in which a first member is connected to one of the engine and a fuel injection pump associated with the engine, and a second member including a shaft connected to the other, said device comprising:

a cam assembly operatively connecting the first and second members to each other;

a hydraulic actuator for actuating the cam assembly;

connector means for operatively connecting the hydraulic actuator to the cam assembly, the hydraulic actuator controllably urging the connector means on and along a first line of action in response to a hydraulic fluid pressure communicated thereto; and returning means for returning the connector means on and along a second line of action which is parallel to and opposite in direction to the first line of action;

said first and second lines of action commonly lying in a plane which is perpendicular to an axis of the shaft of the second member and contains an axis of the hydraulic actuator therein;

the connector means comprising a generally U-shaped connector plate, said plane being parallel to said connector plate;

the connector means further comprising a bracket extending from the connector plate perpendicularly thereto;

the connector means yet further comprising a pin rigidly carried at one end thereof by the bracket and having an axis perpendicular to the second line of action, said first line of action being defined by a point of connection between the bracket and the pin.

2. An injection timing control device as claimed in claim 1, in which the hydraulic actuator comprises a cylindrical bore formed in a cylinder block, and a piston slidably received in said cylindrical bore, the pin integral with the bracket being engaged in a bore formed in the piston through a slot formed in a wall of the cylindrical bore.

* * * * *